United States Patent [19]

Otani

[11] 4,133,998

[45] Jan. 9, 1979

[54] COOKING MODE SELECTOR FOR CONTINUOUSLY VARYING A MEAN OUTPUT LEVEL OF A MAGNETRON IN A MICROWAVE OVEN

[75] Inventor: Akira Otani, Yamatokoriyama, Japan

[73] Assignee: Sharp Kabushiki Kaisha, Osaka, Japan

[21] Appl. No.: 809,021

[22] Filed: Jun. 22, 1977

[30] Foreign Application Priority Data

Jun. 22, 1976 [JP] Japan ..... 51-82260[U]
Apr. 1, 1977 [JP] Japan ..... 52-37929

[51] Int. Cl.[2] ..... H05B 9/06

[52] U.S. Cl. ..... 219/10.55 B; 200/21; 200/38 C

[58] Field of Search ..... 219/10.55 B, 10.55 C, 219/10.55 R; 200/6 B, 27 B, 21, 38 C, 30

[56] References Cited

U.S. PATENT DOCUMENTS

| | | | |
|---|---|---|---|
| 3,114,084 | 12/1963 | Bernaden, Jr. et al. | 200/38 C X |
| 3,286,924 | 11/1966 | Banathy | 200/27 B X |
| 3,824,365 | 7/1974 | Tapper | 219/10.55 B |
| 4,025,804 | 5/1977 | Rickard | 219/10.55 B |

FOREIGN PATENT DOCUMENTS

| | | | |
|---|---|---|---|
| 210558 | 1/1967 | Sweden | 219/10.55 B |

*Primary Examiner*—Arthur T. Grimley
*Attorney, Agent, or Firm*—Birch, Stewart, Kolasch and Birch

[57] ABSTRACT

A cylinder shaped cam member having a longer radius section and a shorter radius section is driven to rotate at a constant velocity around its axis. The ratio of the longer radius section to the shorter radius section is gradually increased along the axis of the cylinder shaped cam member. A contact member associated with an actuator of a normally open switch is disposed in such a manner that the contact member is always brought into contact with the periphery of the cylinder shaped cam member. The normally open switch is closed when the contact member is brought into contact with the longer radius section during the rotation of the cylinder shaped cam member, whereby a magnetron is power supplied through the normally open switch. The location of the contact member is shifted through the use of a suitable selector along the axis of the cylinder shaped cam member, whereby the mean output level of the magnetron is continuously varied in response to the location of the contact member.

6 Claims, 9 Drawing Figures

COOKING MODE SELECTOR FOR CONTINUOUSLY VARYING A MEAN OUTPUT LEVEL OF A MAGNETRON IN A MICROWAVE OVEN

BACKGROUND AND SUMMARY OF THE INVENTION

The present invention relates to a microwave oven and, more particularly, to a variable cooking mode selector for controlling a magnetron output in a microwave oven.

A control system has been proposed, which intermittently enables a magnetron employed in a microwave oven for varying a mean output level in accordance with variations of a repetition rate of magnetron energization.

In a conventional control system of the prior art, a contactless switching system made of a semiconductor circuit, or a complicated cam mechanism is employed to perform the intermittent switching operation. However, both the contactless switching system and the cam mechanism of the prior art are so complicated that a simple control system is highly desirable.

A simplified cam mechanism for varying the mean output level of the magnetron is proposed in my copending application, VARIABLE COOKING MODE SELECTOR IN A MICROWAVE OVEN, Ser. No. 767,149, filed Feb. 9, 1977. In the system disclosed in the above-mentioned application Ser. No. 767,149, the mean output level of the magnetron is selectable at four different levels but cannot be continuously varied.

A system for continuously varying the mean output level of the magnetron is disclosed in U.S. Pat. No. 3,995,133 entitled "VARIABLE POWER CONTROL FOR MICROWAVE OVEN" issued on Nov. 30, 1976. However, the system disclosed in U.S. Pat. No. 3,995,133 is very complicated.

Accordingly, an object of the present invention is to provide a microwave oven, wherein a mean output level of a magnetron employed in the microwave oven is selectable at a desired value.

Another object of the present invention is to provide a variable cooking mode selector of a simple construction for continuously varying a mean output level of a magnetron employed in a microwave oven.

Still another object of the present invention is to provide a switching assembly of a simple construction for intermittently energizing a magnetron employed in a microwave oven.

Yet another object of the present invention is to provide a novel cam structure for intermittently energizing a magnetron employed in a microwave oven.

Other objects and further scope of applicablility of the present invention will become apparent from the detailed description given hereinafter. It should be understood, however, that the detailed description and specific examples, while indicating preferred embodiments of the invention, are given by way of illustraiton only, since various changes and modifications within the spirit and scope of the invention will become apparent to those skilled in the art from this detailed description.

To achieve the above objects, pursuant to an embodiment of the present invention, a cylindrically shaped cam member having a longer radius section and a shorter radius section is driven to rotate at a constant velocity about its axis. The ratio of the longer radius section to the shorter radius section is gradually increased along the axis of the cylindrically shaped cam member.

A contact member associated with an actuator of the normally open switch is disposed in such a manner that the contact member is always brought into contact with the periphery of the cylindrically shaped cam member. The normally open switch is closed when the contact member is brought into contact with the longer radius section of the cylindrically shaped cam member during the rotation of the cylindrically shaped cam member, and is opened when the contact member is brought into contact with the shorter radius section of the cylindrically shaped cam member during the rotation of the cylindrically shaped cam member.

A magnetron power supply circuit is correlated with the normally open switch so as to intermittently energize a magnetron employed in a microwave oven in response to the opening and closing of the normally open switch.

The location of the contact member is shifted along the axis of the cylindrically shaped cam member through the use of a suitable selector, whereby the ratio of the ON period to the OFF period of the normally open switch is selected at a desired value. Therefore, the mean output level of the magnetron employed in the microwave oven is continuously varied in response to the location of the contact member.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
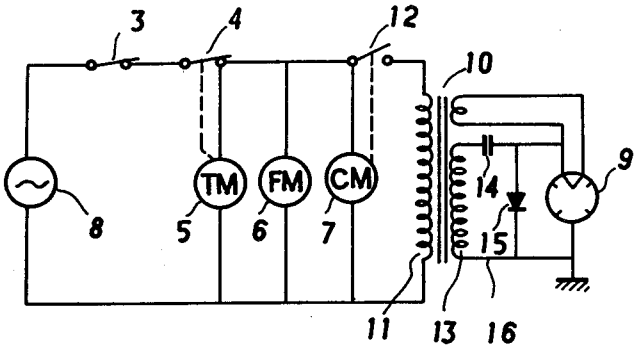
FIG. 1 is a schematic circuit diagram of a microwave oven including a magnetron power supply circuit associated with an example of a cooking mode selector of the present invention.
Figure 9:
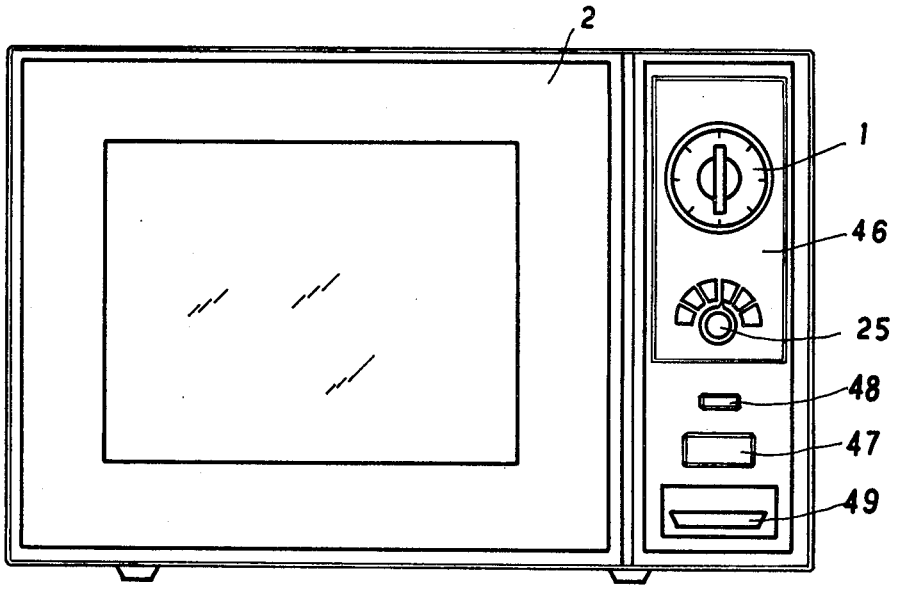
FIG. 9 is a front view of a microwave oven employing the variable cooking mode selector of the present invention.

FIG. 1 shows a circuit construction including a magnetron power supply circuit associated with a variable cooking mode selector of the present invention, and FIG. 9 shows a microwave oven employing the variable cooking mode selector of the present invention.

The microwave oven includes a timer setting knob 1 and an oven door 2. A door switch 3 is associated with the oven door 2 in such a manner that the door switch 3 is closed when the oven door 2 is closed. A timer motor 5 is power supplied through the door switch 3 and a timer switch 4. The timer switch 4 is closed during a time period selected by the timer setting knob 1. Under these conditions, a fan motor 6 and a cam motor 7 are power supplied from a power supply source 8.

A switch 12 is intermittently closed during the rotation of the cam motor 7. The switch 12 is interposed between the power supply source 8 and a primary winding 11 of a leakage transformer 10. A secondary winding 13 of the leakage transformer 10 functions to supply a magnetron 9 with a high voltage when the switch 12 is closed, through a rectifying circuit 16 comprising a capacitor 14 and a diode 15.

Accordingly, the magnetron 9 intermittently generates the microwave energy when the switch 12 is intermittently closed. The mean output level of the magnetron 9 can be controlled by selecting the ratio of the ON period of the switch 12 to the OFF period of the switch 12 at a desired value.

Figure 2:
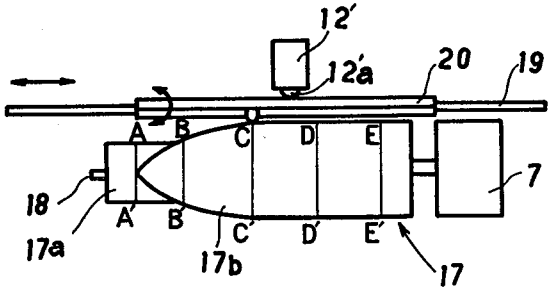
FIG. 2 is a schematic front view for explaining operation of the cooking mode selector of the present invention.
Figure 3:
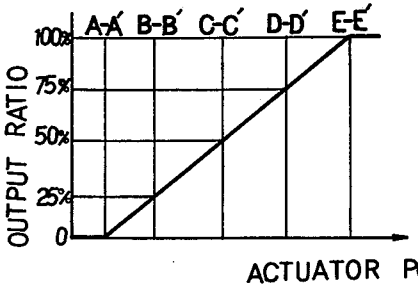
FIG. 3 is a graph showing mean output ratio of a magnetron versus actuator position characteristics, the actuator being employed in the cooking mode selector of FIG. 2.
Figure 4:
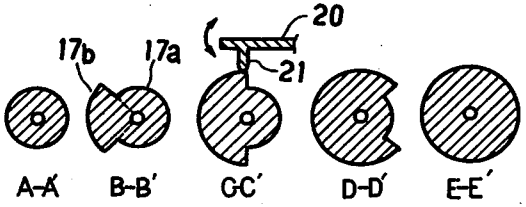
FIG. 4 is sectional views of a cylindrically shaped cam member employed is the cooking mode selector of FIG. 2.

The principle of operation of a variable cooking mode selector of the present invention will be described with reference to FIGS. 2 through 4. A micro switch 12′ corresponds to the switch 12 of FIG. 1. The micro switch 12′ is the normally open type and its movable contact $12'_a$ is biased outward by spring means. A cylindrically shaped cam member 17 is driven to rotate around its axis 18 at a constant velocity by the cam motor 7.

The cylindrically shaped cam member 17 has a longer radius section $17_b$ and a shorter radius section $17_a$. The ratio of the longer radius section $17_b$ to the shorter radius section $17_a$ is gradually varied along the axis 18. More particularly, the cylindrically shaped cam member 17 has a circular section of the longer radius at E—E′ as shown in FIG. 4. The cylindrically shaped cam member 17 has a circular section of the shorter radius at A—A′ as shown in FIG. 4. The ratio of the longer radius section $17_b$ to the shorter radius section $17_a$ is ⅓, 1 and 3 at B—B′, C—C′, and D—D′, respectively.

An actuator member 20 is slidably mounted on a shaft 19. The actuator member 20 includes a contact member 21, which is always brought into contact with the periphery of the cylindrically shaped cam member 17 as shown in FIG. 4. The actuator member 20 is shifted along the axis 18 which is parallel with the shaft 19, and is rotatable about the shaft 19.

When the contact member 21 is brought into contact with the longer radius section $17_b$ of the cylindrically shaped cam member 17 during the revolution of the cylindrically shaped cam member 17, the micro switch 12′ is closed. Contrarily, when the contact member 21 reaches the shorter radius section $17_a$ of the cylindrically shaped cam member 17 during the revolution of the cylindrically shaped cam member 17, the micro switch 12′ is open.

The magnetron 9 is intermittently energized in response to the switching operation of the micro switch 12′. Accordingly, the mean output level of the magnetron 9 is varied in response to the location of the contact member 21 as shown in FIG. 3. When, for example, the contact member 21 is positioned at B—B′, the mean output level of the magnetron 9 is twenty-five percent (25%) of that which is developed when the contact member 21 is positioned at E—E′. It will be clear from FIG. 3 that the mean output level of the magnetron 9 is continuously varied from zero to one hundred percent (0–100%) in response to the location of the contact member 21 carried by the actuator member 20.

Figure 5:
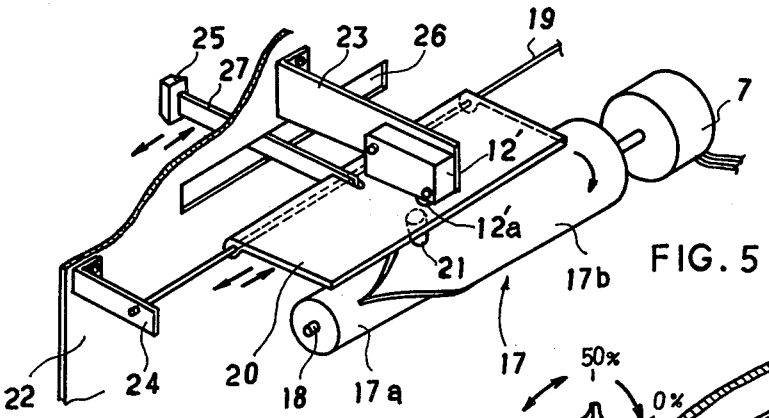
FIG. 5 is a perspective view of an embodiment of a variable cooking mode selector of the present invention.

FIG. 5 shows an embodiment of the variable cooking mode selector of the present invention. Like elements corresponding to those of FIG. 2 are indicated by like numerals.

The microswitch 12′ and the shaft 19 for slidably supporting the actuator member 20 are secured to a front operation panel 22 of the microwave oven via an L-shaped supporting member 23 and an L-shaped supporting member 24, respectively. A control knob 25 is fixed to the actuator member 20 via a lever 27, which is provided through an opening 26 formed in the front operation panel 22. Therefore, the location of the actuator member 20 carrying the contact member 21 is shifted through the use of the control knob 25.

Figure 6:
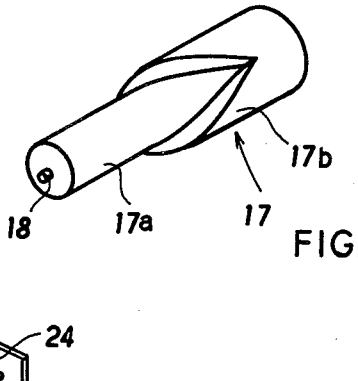
FIG. 6 is a perspective view of a cylindrically shaped cam member employed within the variable cooking mode selector of FIG. 5.

The cylindrically shaped cam member 17 is disposed in such a manner that the axis 18 is parallel with the shaft 19. FIG. 6 shows a typical construction of the cylindrically shaped cam member 17. The cylindrically shaped cam member 17 is driven to rotate at a constant velocity by the cam motor 7. The actuator member 20 is depressed downward by the movable contact $12'_a$ of the micro switch 12′ so that the contact member 21 is always kept in contact with the periphery of the cylindrically shaped cam member 17 during the rotation of the cylindrically shaped cam member 17.

The mean output level of the magnetron is selected at a desired value by shifting the location of the actuator member 20 through the control knob 25.

Figure 7:
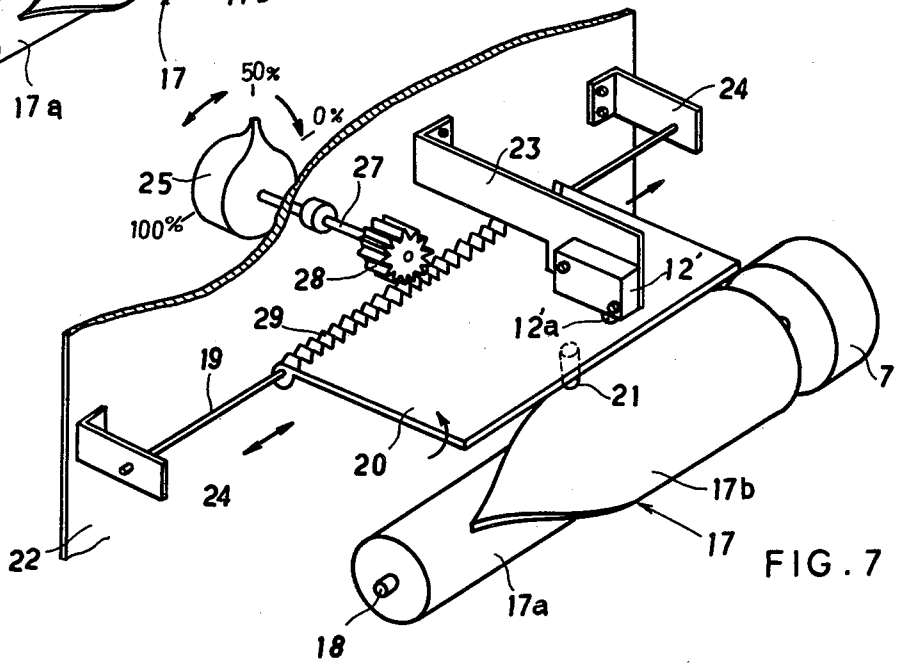
FIG. 7 is a perspective view of another embodiment of a variable cooking mode selector of the present invention.

FIG. 7 shows another embodiment of the variable cooking mode selector of the present invention. Like elements corresponding to those of FIG. 5 are indicated by like numerals.

In this embodiment, the control knob 25 is connected to a gear 28 via a shaft 27 so that the actuator member 20 is driven to slide through a geared portion 29 of the actuator member 20. The geared portion 29 is associated with the gear 28 and, therefore, the actuator member 20 is shifted when the control knob 25 is rotated.

Figure 8:
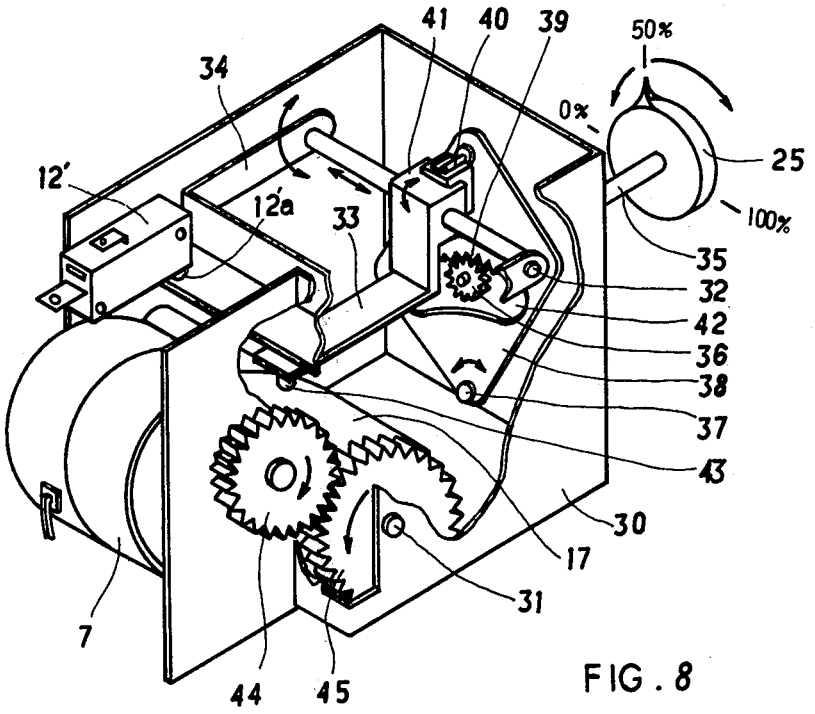
FIG. 8 is a perspective view of still another embodiment of a variable cooking mode selector of the present invention.

FIG. 8 shows still another embodiment of the variable cooking mode selector of the present invention. Like elements corresponding to those of FIGS. 5 and 7 are indicated by like numerals.

A U-shaped supporting frame 30 is provided for securing shafts 31 and 32. The shaft 31 functions to rotatably support the cylindrically shaped cam member 17, and the shaft 32 functions to rotatably support an L-shaped cam periphery follower 33 and a switch actuator 34. The cam periphery follower 33 is rotatable about the shaft 32 and is slidable on the shaft 32. The location of the cam periphery follower 33 is shifted along the shaft 31 through the use of the control knob 25.

The control knob 25 is connected to a gear 36 via a shaft 35, which is provided through the U-shaped supporting frame 30. A diamond shaped plate 38 is rotatably secured around a pin 37, which is fixed to the U-shaped supporting frame 30. The diamond shaped plate 38 includes an opening 42 having a geared portion 39, which is geared to the gear 36 so as to rotate the diamond shaped plate 38 around the pin 37 in response to the rotation of the control knob 25.

The diamond shaped plate 38 further includes a pin 40, which is engaged within a sliding groove 41 formed at the end of the cam periphery follower 33. Therefore, the cam periphery follower 33 is shifted in its position along the shaft 32 in reponse to the rotation of the control knob 25.

The cam periphery follower 33 includes a contact member 43 which is always brought into contact with the periphery of the cylindrically shaped cam member 17. The switch actuator 34 is kept in contact with the cam periphery follower 33 so that the micro switch 12' is closed when the contact member 43 comes into contact with the longer radius section of the cylindriclly shaped cam member 17. The cylindrically shaped cam member 17 is driven to rotate by the cam motor 7 through gears 44 and 45. The micro switch 12' is fixed to the U-shaped supporting frame 30.

Accordingly, the mean output level of the magnetron is selected at a desired value by shifting the location of the cam periphery follower 33 through the use of the control knob 25.

The above-mentioned variable cooking mode selector is disposed within a control section 46 of the microwave oven shown in FIG. 9. The control knob 25 of the embodiment shown in FIG. 8 is controllable from the outside of the microwave oven as shown in FIG. 9. There are provided labels around the control knob 25, such as HIGH, REHEAT, ROAST, SIMMER, DEFROST, and WARM, in order to facilitate the selection of the desired mean output level. The microwave oven shown in FIG. 9 further includes a cooking switch 47, a cook lamp 48 for indicating that the microwave cooking is being performed, and a door latch bar 49.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A variable cooking mode selector comprising:

a cylindrically shaped cam member having a longer radius section and a shorter radius section, the ratio of the longer radius section to the shorter radius section being gradually increased along an axis of the cylindrically shaped cam member;

driving means for rotating said cylindrically shaped cam member about said axis;

a contacting member;

means for depressing said contacting member toward said cylindrically shaped cam member so that said contacting member is always brought into contact with the periphery of the cylindrically shaped cam member;

a micro switch;

means disposed between said micro switch and said contacting member so as to close said micro switch when said contacting member is brought into contact with the longer radius section of the cylindrically shaped cam member or to open said micro switch when said contacting member is brought into contact with the shorter radius section of the cylindrically shaped cam member; and selection means for shifting the location of the contacting member along the axis of the cylindrically shaped cam member.

2. The variable cooking mode selector of claim 1, wherein said micro switch is closed only when said contacting member is brought into contact with said longer radius section of the cylindrically shaped cam member during the rotation of the cylindrically shaped cam member.

3. The variable cooking mode selector of claim 2, wherein said micro switch is a normally open switch.

4. A microwave oven comprising a microwave generation means and a variable cooking mode selector for varying a mean output level of said microwave generation means, said variable cooking mode selector comprising:

a cylindrically shaped cam member having a longer radius section and a shorter radius section, the ratio of the longer radius section to the shorter radius section being gradually increased along an axis of the cylindrically shaped cam member;

driving means for rotating said cylindrically shaped cam member about said axis;

a contacting member;

means for depressing said contacting member toward said cylindrically shaped cam member so that said contacting member is always brought into contact with the periphery of the cylindrically shaped cam member;

a micro switch through which said microwave generation means is supplied with power;

means disposed between said micro switch and said contacting member so as to close said micro switch when said contacting member is brought into contact with the longer radius section of the cylindrically shaped cam member or to open said switch when said contact member is brought into contact with the shorter radius section of the cylindrically shaped cam member; and selection means for shifting the location of the contacting member along the axis of the cylindrically shaped cam member.

5. A microwave oven according to claim 4, wherein said micro switch is closed only when said contacting member is brought into contact with said longer radius section of the cylindrically shped cam member during the rotation of the cylindrically shaped cam member.

6. A microwave oven according to claim 5, wherein said micro switch is a normally open switch.

* * * * *